US009044112B2

(12) United States Patent
Lee

(10) Patent No.: US 9,044,112 B2
(45) Date of Patent: Jun. 2, 2015

(54) EASILY PORTABLE WINE GLASS

(71) Applicant: Hyung Ho Lee, Cheongju-si (KR)

(72) Inventor: Hyung Ho Lee, Cheongju-si (KR)

(73) Assignee: Hyung Ho Lee, Cheongju-Si (KR)

( * ) Notice: Subject to any disclaimer, the term of this patent is extended or adjusted under 35 U.S.C. 154(b) by 0 days.

(21) Appl. No.: 14/124,123

(22) PCT Filed: Nov. 7, 2012

(86) PCT No.: PCT/KR2012/009294

§ 371 (c)(1),
(2) Date: Dec. 5, 2013

(87) PCT Pub. No.: WO2013/085149

PCT Pub. Date: Jun. 13, 2013

(65) Prior Publication Data

US 2014/0291335 A1 Oct. 2, 2014

(30) Foreign Application Priority Data

Dec. 7, 2011 (KR) ..... 20-2011-0010861 U

(51) Int. Cl.
*A47G 19/22* (2006.01)
*A45F 3/20* (2006.01)

(52) U.S. Cl.
CPC ..... *A47G 19/2205* (2013.01); *A45F 3/20* (2013.01); *A45F 2003/205* (2013.01); *A47G 19/2255* (2013.01)

(58) Field of Classification Search
CPC ..... B65D 21/0233; A47G 19/2205; A47G 19/2255; A45F 3/20; A45F 2003/205
USPC ..... 206/509, 426, 505, 499, 818; 215/10, 215/377; 220/630, 703
See application file for complete search history.

(56) References Cited

U.S. PATENT DOCUMENTS

| | | | | | |
|---|---|---|---|---|---|
| 83,341 | A | * | 10/1868 | Towndrow | 215/377 |
| 2,996,208 | A | * | 8/1961 | Schroeder | 215/377 |
| 3,013,688 | A | * | 12/1961 | Luning | 215/376 |
| 3,393,819 | A | * | 7/1968 | Van De Walle et al. | 215/372 |
| 5,014,865 | A | * | 5/1991 | Sauber | 215/377 |
| 5,513,764 | A | * | 5/1996 | Harrison et al. | 215/372 |
| 5,996,825 | A | * | 12/1999 | Gordon et al. | 215/10 |
| 6,662,959 | B1 | * | 12/2003 | Westerhold | 215/378 |

(Continued)

FOREIGN PATENT DOCUMENTS

| | | | |
|---|---|---|---|
| JP | 2001-039445 | A | 2/2001 |
| JP | 3148886 | U | 3/2009 |

(Continued)

*Primary Examiner* — Steven A. Reynolds
(74) *Attorney, Agent, or Firm* — Harness, Dickey & Pierce, P.L.C.

(57) ABSTRACT

The present invention relates to an easily portable wine glass, and more specifically, to an easily portable wine glass containing an accommodation portion into which wine is poured, and a supporting plate having a protruded handle, wherein the accommodation portion and the supporting plate are detachably coupled using a magnet. When carrying the wine glass, the supporting plate serves as a stopper covering the upper portion of the accommodation portion, thereby preventing infiltration of foreign matter. In addition, since there is no need for forming a hole at the bottom of the accommodation portion by coupling the accommodation portion and the handle using a magnet, it is unnecessary to worry about the leakage of wine when pouring wine into the accommodation portion of the wine glass.

3 Claims, 4 Drawing Sheets

(56) References Cited

U.S. PATENT DOCUMENTS

| | | | | |
|---|---|---|---|---|
| 7,861,888 | B2 * | 1/2011 | Niedzwiecki | 220/703 |
| 8,829,824 | B2 * | 9/2014 | Scott | 315/377 |
| 2002/0104819 | A1 * | 8/2002 | Matsui | 215/377 |
| 2008/0179328 | A1 * | 7/2008 | Anderson | 220/475 |
| 2011/0174763 | A1 * | 7/2011 | Kennedy | 215/377 |
| 2013/0020333 | A1 * | 1/2013 | Scott | 220/630 |
| 2013/0334166 | A1 * | 12/2013 | Garipalli et al. | 215/377 |

FOREIGN PATENT DOCUMENTS

| | | | |
|---|---|---|---|
| KR | 10-2008-0006233 | A | 1/2008 |
| KR | 20-0455115 | Y1 | 8/2011 |

* cited by examiner

EASILY PORTABLE WINE GLASS

TECHNICAL FIELD

The present invention relates to portable wine glass; more specifically, it pertains to portable wine glass with the structural component that consists of accommodation area and protruding supporting plate that can be detachable through the magnets. When present invention is a portable wine glass, supporting plate functions as the stopper for the top portion to keep other substances out. As the magnet attaches the accommodation area and the handle, there is no need to create a hole in the bottom portion of the accommodation area wherein it stops the wine leakage when the wine is poured within; the user doesn't need to worry about the wine leaking from the glass.

BACKGROUND ART

Wine is usually made by naturally fermenting the grapes wherein it includes various minerals and vitamins as well as antioxidants which are proven to be effective in treating heart disease and other degenerative diseases.

Wine consumption has increased due to its antioxidation effects and as better quality of living overall. Consequentially, various wine glasses had been manufactured along with the increase of wine comsumption for the consumers. There are no changes in regards to sizes of the wine glasses so that the consumers can enjoy wine with its unique fragrance and taste.

FIG. 4 is illustrating a wine glass made from the prior arts. The wine glass as mentioned above has a hollow spot and the area that accommodates the wine wherein the top portion is narrow and lower portion is widely formed in which accommodation area has a handle in the lower portion so that people may drink the wine within the area by using the handle for the grip; supporting plate is formed at the bottom of the handle for the wine glass to stand on its own on the ground.

Shape of the wine glass is '♀' and the wine contained in the accomodation area is consumed by gripping the handle.

However, problem with pre-existing wine glass is that the accommodating area and the handle is formed as one, thus making it less portable when the size of the wine glass is considered.

Further, accommodation area of the wine glass is thinner on top and thicker on the bottom which creates a problem when the glass is carried around as the top can break easily from shock.

And even when the wine glass could be portable in function, foreign substances can easily get in on the hollow spot in the accommodating area where it makes it difficult for people to

SUMMARY OF INVENTION

Technical Problem

Accordingly, the present invention has been made in view of the above-mentioned problems occurring in the prior art, and it is an object of the present invention to provide portable wine glass with the structural component that consists of accommodation area and protruding supporting plate that are made detachable through the magnets. When present invention is a portable wine glass, supporting plate functions as the stopper for the top portion to keep other substances out. As the magnet attaches the accommodation area and the handle, there is no need to create a hole in the bottom portion of the accommodation area wherein it stops the wine leakage when the wine is poured within; the user doesn't need to worry about the wine leaking from the glass.

Solution to Problem

To accomplish the above object according to the present invention, portable wine glass with components such as supporting plate which includes accommodation area and the handle wherein the supporting place with accommodation area and handle are separately formed; groove joint is placed on the center part of the accommodation area, where metal plate is installed in it; in-groove is installed at the higher end of the handle where magnet is inserted so that it will be attached to the metal plate; it is one of the characteristics of this present invention that when the wine glass would be used with portable function, the handle will be inserted into the accommodation area at the opening where magnet protruding from the end of the handle will be attached to the metal plate which is inserted into the groove joint on the lower part of the accommodation area wherein the supporting plate would be closing up the hole of the accommodation area.

Advantageous Effects of Invention

According to the present invention, when the user wishes to have a portable wine glass, the supporting plate will act as the stopper that covers the accommodation area to stop other substances from entering into the glass wherein the magnet is used to attach the handle and the accommodation area so that there will be no need to form a hole on the bottom of the accommodation area where wine will not leak when it is poured into the glass.

Figure 1:
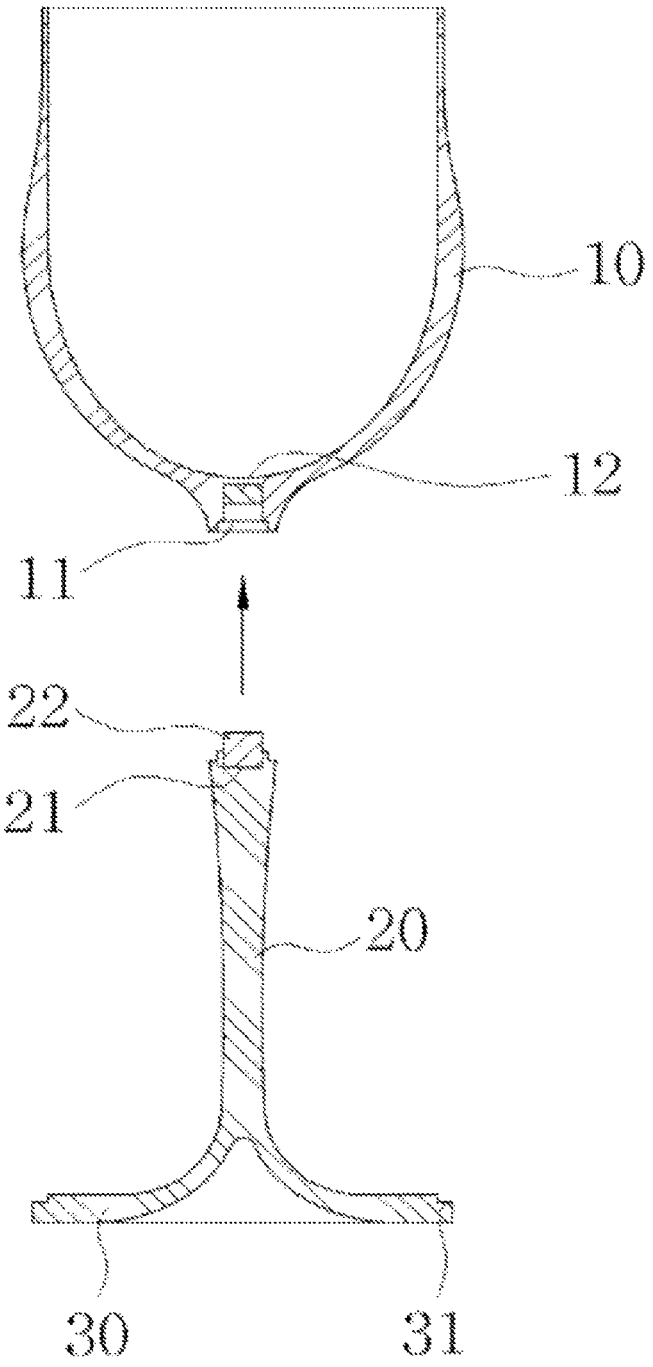
FIG. 1 is a cross section illustrating portable wine glass disassembled according to the present invention.

10: Accommodation area, 11: Groove joint
12: Metal plate, 20: Handle
30: Supporting plate, 31: Stair-shaped section

DETAILED DESCRIPTION OF EXEMPLARY EMBODIMENTS

The present invention can be explained by using FIG. 1 to FIG. 3 as an exemplary embodiment as follows.

According to illustrations, present invention includes:

Supporting plate 30 which is composed of accommodation area 10 and handle 20 of the wine glass 1 that is portable has the following characteristics;

Supporting plate 30 composed of accommodation area 10 and handle 20 are separately formed;

On the bottom of the accommodation area that had been mentioned above, groove joint formed on the lower central part has a metal plate 12 installed in it;

On the upper side of the handle 20, in-groove 21 is installed at the end and the magnet 22 that will be attached to the metal plate 12 will be joined with the in-groove 21;

When the wine glass is to be used as a portable wine glass, bottom part of the accommodation area 10 is on the middle and the metal plate 12 and the magnet 22 would be attached to it as the handle 20 which will be attached to the top part of the accommodation area 10 so that the supporting plate 30 will be able to block the end part of the hole.

Further, stair shaped part 31 which is to be inserted in to the accommodation area 30 at the opening which is located on the outside of the supporting plate 30.

The present invention pertains to the wine glass that can be disassembled and assembled wherein the supporting plate 30 closes the opening in the accommodation area 10 to keep foreign substances out which makes the wine glass portable and sanitary.

As it had been illustrated, wine glass of the present invention is composed of accommodation area 10 with concave shape for holding the wine and the handle 20 that is joined with the bottom part of the accommodation area 10 and the supporting plate 30 that forms the lower part.

The accommodation area 10 and the supporting plate 30 have been formed separately.

In the accommodation area that had been mentioned above 10, groove joint 11 is formed on the central lower part as it had been illustrated on FIG. 1 wherein the metal plate 12 which will be attached to the magnet 22.

Further, in-groove 21 will be inserted into the higher part at the end of the handle 20 and cylindrical magnet 22 would be inserted into the in-groove to be joined together.

It is recommended that top part of the magnet 22 be exposed to top part of the in-groove 21.

Further, it is recommeded that groove joint 11 is formed so that the bottom part will form the large diameter and higher part will form a small diameter evenly where higher part of the handle 20 will be inserted into the groove joint 11 as the magnet 22 would be inserted into the small diameter of the groove joint 11.

Figure 2:
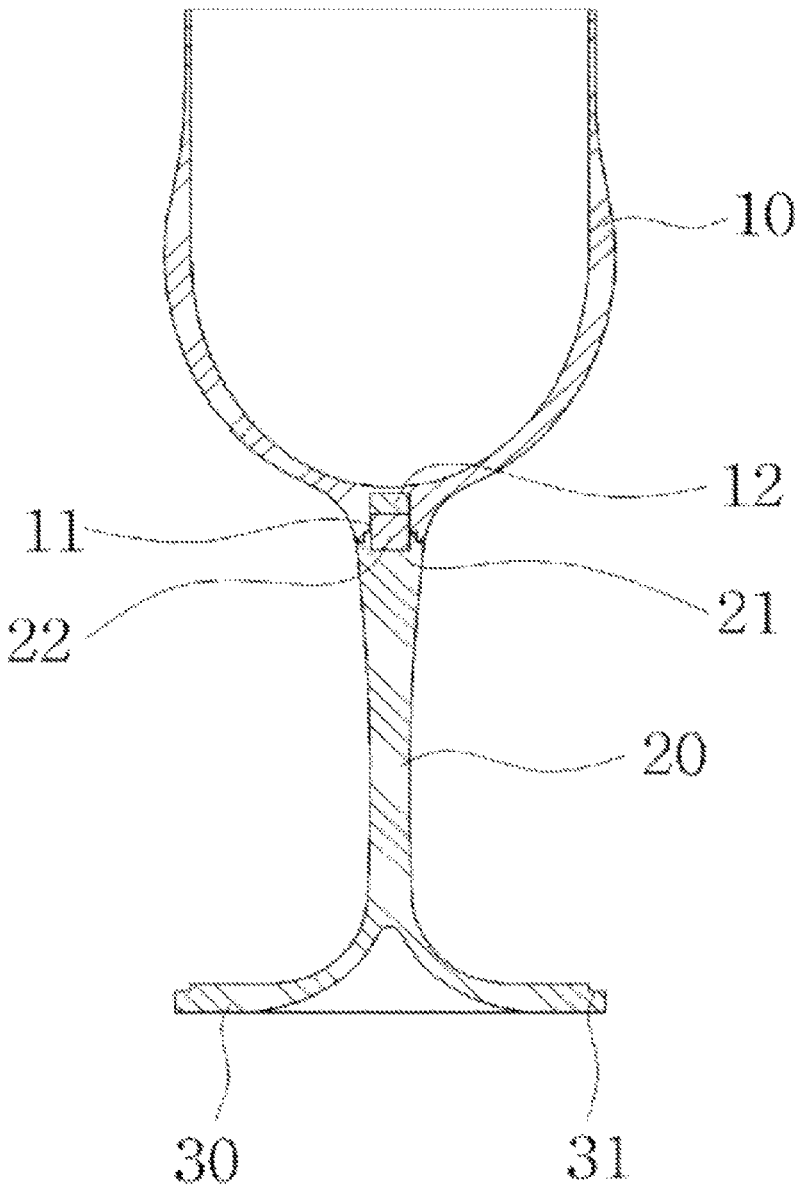
FIG. 2 is a cross section illustrating portable wine glass put together according to the present invention.

When the present invention will be used as a regular wine glass as seen on FIG. 2, the handle 20 should be inserted into the groove joint 11 formed on the lower part of the accommodation area 10 wherein the magnet 22 would be attached to the metal plate 12 and form a wine glass that would be composed of accommodation area 10, handle 20 and the supporting plate 30.

As the wine glass created according to the present invention does not have a hole in the accommodation area 10, there is no need to worry about the leakage when the wine is poured into the accommodation area 10.

Figure 3:
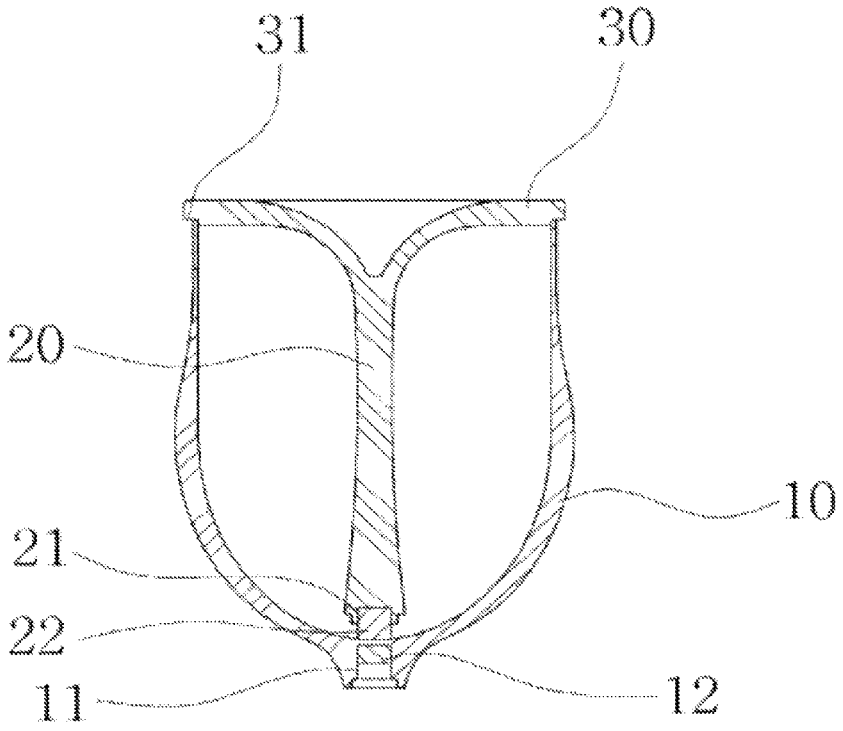
FIG. 3 is a cross section illustrating the wine glass with the handle attached on top to make it portable according to the present invention.
Figure 4:
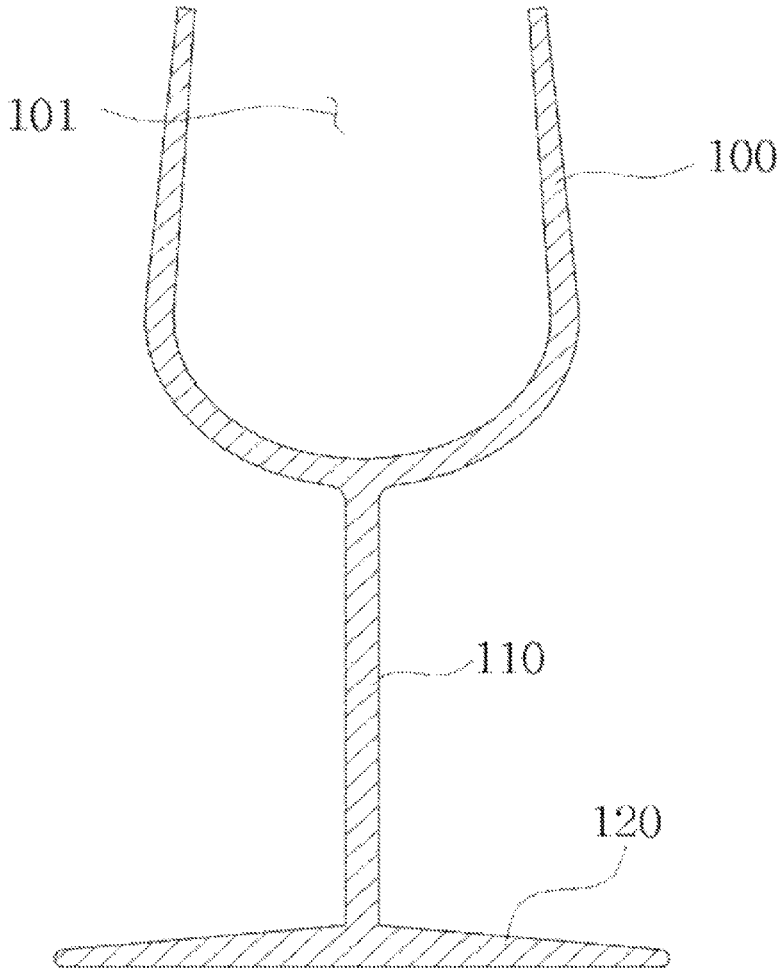
FIG. 4 is a cross section that illustrates pre-existing wine glass according to the present invention.

On the other hand, when the wine glass of the present invention would be used with the portable function, the handle 20 will be inserted into the accommodation area 10 at the opening where magnet 22 protruding from the end of the handle 20 will be attached to the metal plate 12 which is inserted into the groove joint 11 on the lower part of the accommodation area wherein the supporting plate 30 would be closing up the hole of the accommodation area 10 as seen on FIG. 3

User can now safely carry the wine glass in the bag which is smaller in size and had been put together so that accommodation area 10 will be sealed.

Further, when the supporting plate 30 will seal the hole in the accommodating area 10, stair-shaped section 31 which is at the outer area of the supporting plate 30 which will be inserted into the inner part of the accommodation area 10 where it will be completely sealed in order to keep foreign substances out all together.

Best Mode

Purpose of the present invention is for wine glass to be made portable by using the supporting plate with protruding accommodating area and handle where it can be detachable through the magnet wherein the supporting plate will act as the cover for the top part of the accommodating area.

What is claimed is:

1. A portable wine glass comprising:

a supporting plate having a handle, wherein a groove is formed at an end of the handle and a magnet is placed in the groove in a manner that the magnet protrudes from the end of the handle, and an accommodation area, wherein a groove is formed at a lower central part of the accommodation area and a metal plate is placed in the groove, wherein the handle is configured to be inserted into the groove of the accommodation area, wherein the magnet and the metal plate are disposed in a manner that the handle is magnetically attachable to the accommodation area from a bottom direction of the accommodation area as well as a top direction of the accommodation area, wherein the supporting plate is configured to cover a top opening of the accommodation area when the supporting plate is attached from a top direction of the accommodation area, and wherein a stair-shaped part is formed on an outer area of the supporting plate in a manner that a diameter of a lower part is bigger than a diameter of a upper part, and the stair-shaped part is configured to be inserted into a top opening of the accommodation area.

2. The portable wine glass of claim 1, wherein the stair-shaped part is configured to seal the top opening of the accommodation area.

3. The portable wine glass of claim 1, wherein the magnet is cylindrical in shape.

* * * * *